US006138973A

United States Patent [19]

Woodward

[11] Patent Number: 6,138,973

[45] Date of Patent: Oct. 31, 2000

[54] ADJUSTABLE SEAT PEDESTAL

[75] Inventor: Bobby Leo Woodward, Kaufman, Tex.

[73] Assignee: Brunswick Corporation, Tulsa, Okla.

[21] Appl. No.: 09/153,127

[22] Filed: Sep. 15, 1998

[51] Int. Cl.[7] ..... F16M 13/00; F16M 11/26

[52] U.S. Cl. ..... 248/423; 248/188.5

[58] Field of Search ..... 248/161, 162.1, 248/224.8, 222.41, 223.21, 413, 423, 157, 188.1, 188.2, 188.4, 188.5

[56] References Cited

U.S. PATENT DOCUMENTS

| | | | |
|---|---|---|---|
| 3,845,926 | 11/1974 | Wahls | 248/162.1 |
| 4,456,298 | 6/1984 | Gottstein | 297/353 |
| 5,011,174 | 4/1991 | Ross-Clunis | 280/287 |
| 5,335,754 | 8/1994 | Gibson | 182/204 |
| 5,372,287 | 12/1994 | Deguevara | 224/510 |
| 5,383,644 | 1/1995 | Huse | 248/523 |
| 5,513,825 | 5/1996 | Gutgsell | 248/188.5 |
| 5,746,152 | 5/1998 | Huse | 114/363 |

*Primary Examiner*—Ramon O. Ramirez
*Assistant Examiner*—David Heisey
*Attorney, Agent, or Firm*—Wood, Phillips, VanSanten, Clark & Mortimer

[57] ABSTRACT

A seat pedestal comprised of a first tubular vertical support member attached to an underlying deck by a base member, a second tubular member telescoped within the first member, means for attaching a seat to the top of the second member, and means for adjusting the height of the second member within the first comprising a vertical slot in the second member and a plurality of vertically spaced horizontal radial slots intersecting and extending from the vertical slot and a stationary pin extending from the first member through the slot and about which the second member may be changed in height by positioning the pin selectively within one of the horizontal slots.

8 Claims, 2 Drawing Sheets

ADJUSTABLE SEAT PEDESTAL

FIELD OF THE INVENTION

The invention relates to supports for seating, adjustable in height, having particular application in the marine environment.

BACKGROUND OF THE INVENTION

Aboard boats, particularly fishing boats, it is desirable to adjust the height of individual seats to suit the needs of the occupant. While various means of achieving this objective are in use, the invention is believed to offer a simple and secure alternative for mounting and adjusting the height of a seat.

SUMMARY OF THE INVENTION

The invention is a seat pedestal comprised of a first tubular vertical support member attached to an underlying deck by a base member, a second tubular member telescoped within the first member, means for attaching a seat to the top of the second member, and means for adjusting the height of the second member within the first comprising a vertical slot in the second member and a plurality of vertically spaced horizontal radial slots intersecting and extending from the vertical slot and a stationary pin extending from the first member through the slot and about which the second member may be changed in height by positioning the pin selectively within one of the horizontal slots. The pin comprising means for clamping the second member in the selected height position including a nut positioned within the second member to receive a threaded end of the pin, a handle on the opposite end of the pin positioned outside the wall of the first tubular member for turning the pin so that it draws the nut tightly against the interior wall of the second tubular member, thus preventing movement of the second member. The horizontal slots are turned up at the end to prevent rotation of the second member and the attached seat once the pin is positioned therein.

DETAILED DESCRIPTION OF THE DRAWINGS

Figure 1:
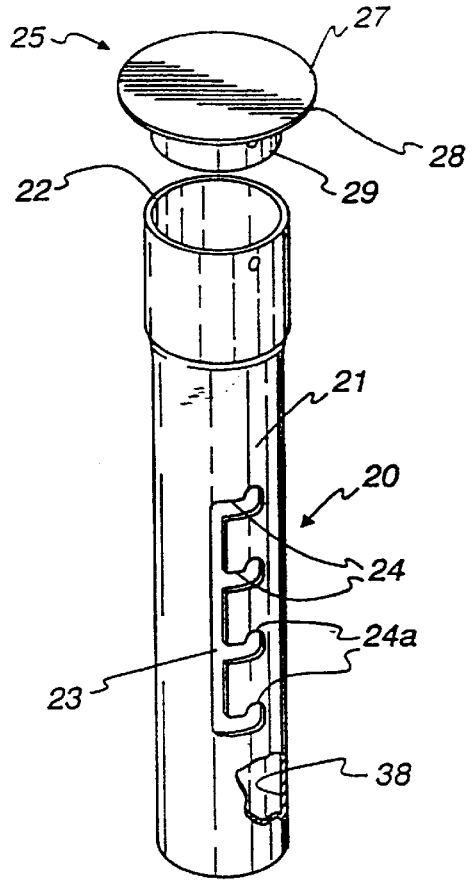
FIG. 1 is a side view of the inner tubular member of the invention with a seat base poised for insertion therein.
Figure 2:
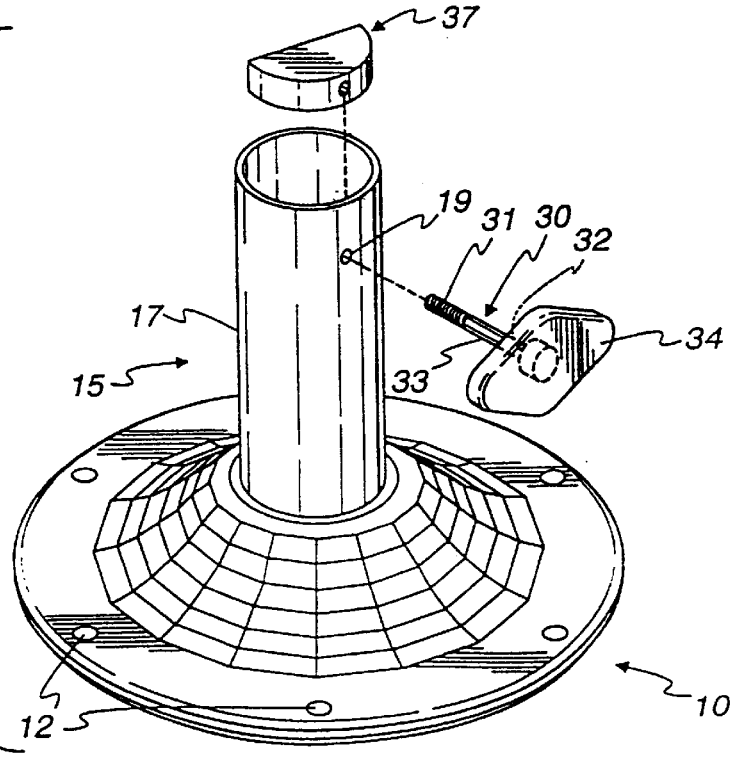
FIG. 2 is a perspective view of the assembled base and outer tubular member of the invention with the locking pin and companion nut positioned for assembly thereto.

FIGS. 1 and 2 present an exploded view of the invention, showing a circular flanged base 10 having a plurality of bolt holes 12 for securing the base 10 to an underlying floor or deck (not shown).

Figure 3:
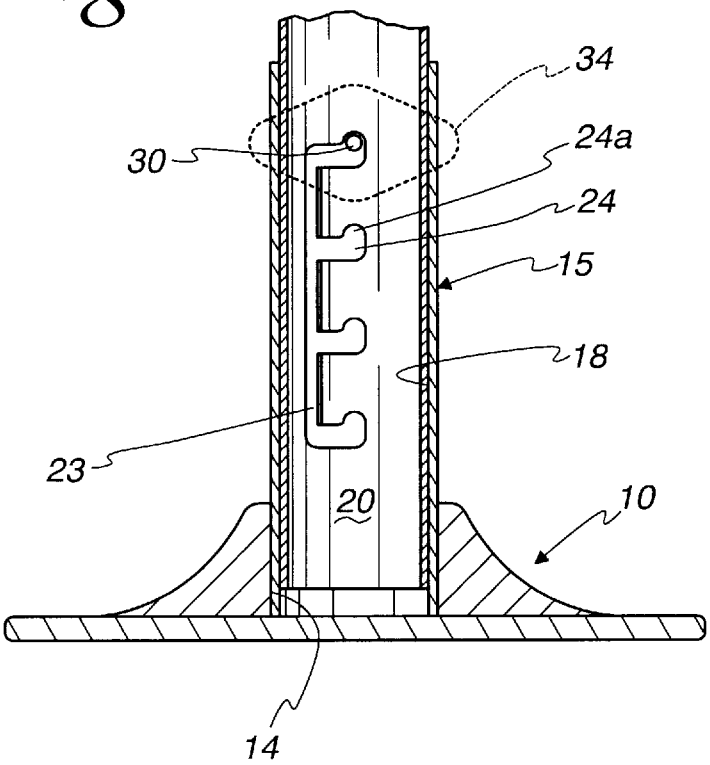
FIG. 3 is a side view of the adjustable seat pedestal of the invention, partially cut away, illustrating the inner seat supporting member in the lowest selectable position.
Figure 4:
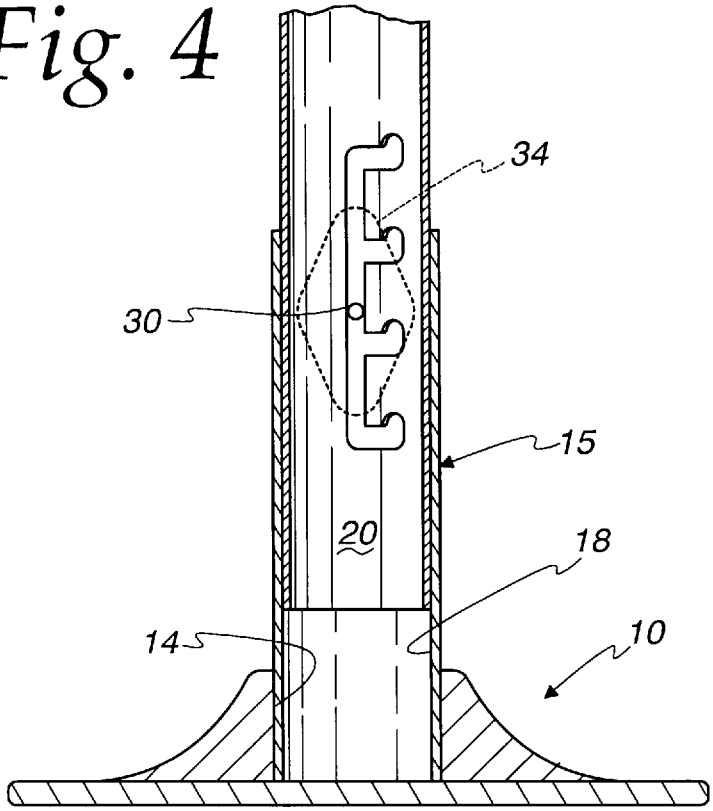
FIG. 4 is a side view of the invention, partially cut away, showing the inner member of the pedestal in-between selectable height positions.

A first tubular support member 15, seen in FIGS. 2, 3 and 4, is seated in the base 10. A second tubular support member 20 is sized to telescope within the first tubular member 15. A fixture 25 configured for attachment to an individual seat of the user's choice comprises a flat upper surface 27, and a tapered midsection 28 extending downwardly from the flat surface 27 and terminating in a cylindrical section 29 sized to fit closely within the top 22 of the inner tubular support member 20.

Referring to FIG. 2, the inner tubular support member 20 is supported at a selected height within the outer lower tubular member 15 by a pin 30 which extends through a hole 19 in the side wall 17 of the outer member 15 and threads into a receiving nut 35 disposed within the inner tubular member 20. The nut 35 has an arcuate surface 37 shaped to match the inside wall 38 of the inner tubular member 20.

The inner tubular member 20 has an axial (vertical) slot 23 cut through the wall 21 thereof sized to permit the pin 30 to pass radially therethrough within the slot 23 and engage the nut 35.

The pin 30 is cylindrical and has an inner end 31 which is threaded for engagement with the nut 35. The wall 21 fully surrounds the slot 23. The remainder of the cylindrical pin 30 is unthreaded to ease its passage within the vertical slot 23 and into the horizontal slots 24 described below. A handle 34 is attached to the outer end of the pin 30 for turning the pin 30. The handle 34 includes a cylindrical shoulder 32 which bears against the outer wall 17 of the lower support member 15 as the pin is threaded into the nut 35. Upon assembly of the pedestal, the nut 35 is positioned inside the inner tubular member 20 with its arcuate surface 37 adjacent the inner arcuate surface 38 of the inside of tubular member 20. The large area of surface contact between the nut and the member 20 provided by these matching surfaces enhances the holding power of the nut.

To adjust the height of the seat pedestal, the handle 34 is turned so that the nut 35 is loosened. The inner tubular member 20 may now be rotated and raised and lowered as desired. By rotating the member 20 counterclockwise (as viewed from above) the pin is positioned in the vertical slot 23. The member 20 may now be raised or lowered to the desired height and rotated clockwise so that the pin moves into the nearest horizontal slot 24 until the pin 30 moves into the upturned end 24*a* of the slot 24. The handle is then tightened, drawing the nut 35 and the inner member 20 tightly against the outer member 15 to hold the seat in the selected position.

Referring to FIG. 3, the base 10 has a cylindrical opening 14 positioned at the center thereof sized to tightly receive the lower end 18 of the outer tubular member 15. Any suitable means, such as a pin or bolt (not shown) may be used to secure the lower end of outer member 15 within the opening 14 in the base 10.

FIGS. 3 and 4 illustrate the adjustable inner support tube 20 of the invention at two different heights. To facilitate a height adjustment, the axial (vertical) slot 23 is cut from the side wall 21 of the inner moving tubular member 20 of the seat support; and, the plurality of vertically spaced radial (horizontal) slots 24 are also cut into the side wall 21. The horizontal slots 24 intersect and commence at the vertical slot 23 and extend radially around the member 20 through an arc of approximately thirty degrees. The length of the slots 24 is not critical; however, if they are too long they tend to weaken the tubular member 20. The ends 24*a* of the slots 24 opposite the vertical slot 23 are upturned so that they extend vertically for a distance about equal to the diameter of the pin 30, so that when the pin 30 is at rest in the end 24*a* of a slot 24, the seat supporting inner tubular member 20 cannot rotate. Provision for rotation of the seat itself can be made, but is not the subject of this application.

When the pedestal is assembled, the inner tubular member 20 is positioned with one of the slots 23 or 24 aligned with the hole 19 in the outer tubular member 15. The pin 30 is inserted through the hole 19 and the selected slot and threaded into the nut 35. The unthreaded portion 33 of the pin 30 should extend through the hole 19 and the slots 23 and 24 as the inner member is rotated and moved to the selected vertical position.

With the pin 39 loosely tightened into the nut 35, the inner tubular member 20 may be rotated until the pin 30 is within the slot 23. From this position, the member 20 may be raised or lowered to the desired height. At this point the operator must select one of the vertically spaced horizontal slots on which to rest the member 20, and rotate the member 20 (clockwise as viewed from above) so that the pin 30 moves into the selected slot 24 all the way to the end and up into the upturned end 24*a* of the slot 24. To lock the seat in the selected position, the handle 34 is turned so as to thread the pin 30 into the nut 35, whereby the tubular members 15 and 20 are drawn together and further movement between the two is prevented by friction.

FIG. 3 shows the pedestal in the lowest position. FIG. 4 shows the inner tubular member 20 in motion between horizontal slots 24 with the pin 30 in the vertical slot 23.

Those skilled in the art will realize that this configuration of the seat pedestal is but one illustration of the invention, and that minor variations are possible without departing from the nature of the invention disclosed and claimed herein.

We claim:

1. A height adjustable pedestal for a seat, said height adjustable pedestal comprising:

a base engagable with a floor or deck upon which a seat is to be supported;

a first vertical tubular member projecting upwardly from the base and having a side wall;

a second vertical tubular member having a side wall and a diameter sized to telescope within the first tubular member, the second tubular member being rotatable within the first tubular member and having an upper end to which a seat can be attached, the second tubular member having a vertical slot and a plurality of vertically spaced horizontal slots in the side wall thereof, the horizontal slots in communication with the vertical slot and extending radially therefrom for a preselected distance; and a pin extending through the side wall of the first vertical member and through the side wall of the second vertical member for engaging a selected one of the horizontal slots, whereby the second vertical member is retained at a selected vertical position within the first vertical member, a first and second of the horizontal slots having an upturned end to receive the pin, whereby with the pin in the upturned end of either of the first and second horizontal slots, the first and second vertical tubular members cannot be relatively rotated to allow movement of the pin into the vertical slot.

2. The height adjustable seat pedestal of claim 1 wherein the said pin comprises a threaded end portion, a central unthreaded portion, and a handle opposite the threaded end, a nut disposed within the second tubular member and threaded onto the pin, the nut having an arcuate side wall matching the curvature of the interior of the side wall of the second tubular member, the handle comprising a shoulder extending axially thereof toward the threaded end so as to engage the side wall of the first tubular member when the pin is threaded into the nut, whereby threading the pin into the nut draws the side walls of the first and second tubular members together between the nut and the shoulder, locking them together by friction.

3. The height adjustable seat pedestal of claim 2 in which the nut comprises an elongate half cylinder.

4. The height adjustable seat pedestal according to claim 1 wherein the side wall of the second vertical tubular member fully surrounds the vertical and horizontal slots so that the pin must be radially directed into the vertical and horizontal slots.

5. A height adjustable pedestal for a seat, said height adjustable pedestal comprising:

a base engagable with a floor or deck upon which a seat is to be supported;

a first vertical tubular member projecting upwardly from the base and having a side wall;

a second vertical tubular member having a side wall, the first and second vertical tubular members telescopingly engaged, one within the other, and rotatable relative to each other around a vertical axis;

one of the first and second vertical tubular members having a vertical slot and a plurality of vertically spaced horizontal slots in communication with the vertical slot and extending radially therefrom; and a pin extending through the side wall of the other of the first and second vertical tubular members and the side wall of the one of the first and second vertical tubular members for engaging a selected one of the horizontal slots, whereby the one of the first and second vertical tubular members is retained in a selected vertical position relative to the other of the first and second vertical tubular members, a first and second of the horizontal slots having an end vertically offset in the same vertical direction to receive the pin, whereby with the pin in the vertically offset end of either of the first and second horizontal slots, the first and second vertical tubular members cannot be relatively rotated to allow movement of the pin into the vertical slot.

6. The height adjustable pedestal for a seat according to claim 5 wherein the pin comprises a threaded end portion, a central unthreaded portion, and a handle opposite the threaded end, a nut disposed within the second tubular member and threaded onto the pin, the nut having an arcuate side wall matching the curvature of the interior of the side wall of the second tubular member, the handle comprising a shoulder extending axially thereof toward the threaded end so as to engage the side wall of the first tubular member when the pin is threaded into the nut, whereby threading the pin into the nut draws the side walls of the first and second tubular members together between the nut and the shoulder, locking them together by friction.

7. The height adjustable pedestal for a seat according to claim 6 in which the nut comprises an elongate half cylinder.

8. The height adjustable pedestal for a seat according to claim 5 wherein the side wall of the one of the first and second vertical tubular members fully surrounds the vertical and horizontal slots so that the pin must be radially directed into the vertical and horizontal slots.

* * * * *